US009044975B2

(12) United States Patent
Yen

(10) Patent No.: US 9,044,975 B2
(45) Date of Patent: Jun. 2, 2015

(54) SUPPORTING MECHANISM AND PRINTING DEVICE THEREOF

(75) Inventor: Kai-Chieh Yen, Taipei (TW)

(73) Assignee: HiTi Digital, Inc., Xindian Dist., New Taipei (TW)

( * ) Notice: Subject to any disclaimer, the term of this patent is extended or adjusted under 35 U.S.C. 154(b) by 503 days.

(21) Appl. No.: 13/451,563

(22) Filed: Apr. 20, 2012

(65) Prior Publication Data

US 2013/0175906 A1 Jul. 11, 2013

(30) Foreign Application Priority Data

Jan. 9, 2012 (TW) ..... 101100859 A

(51) Int. Cl.
*B41J 15/04* (2006.01)
*B41J 29/02* (2006.01)
*B41J 29/13* (2006.01)

(52) U.S. Cl.
CPC ..... *B41J 15/042* (2013.01); *B41J 29/13* (2013.01); *B41J 29/02* (2013.01)

(58) Field of Classification Search
CPC ..... B65H 16/02; B65H 16/028; B65H 16/04; B41J 15/04; B41J 29/02; B41J 29/06; B41J 15/042; B41J 29/13; G03G 15/6517; G03G 15/652
USPC ..... 400/613; 242/595, 596, 596.1, 596.8, 242/597.8, 598.1, 598.4, 598.5, 598.6; 312/269, 270, 271, 273–276, 301, 311, 312/325; 248/637, 672
See application file for complete search history.

(56) References Cited

U.S. PATENT DOCUMENTS

| | | | | |
|---|---|---|---|---|
| 2,319,651 | A * | 5/1943 | Wilkinson et al. | 126/340 |
| 5,528,278 | A * | 6/1996 | Takizawa et al. | 347/218 |
| 6,183,153 | B1 * | 2/2001 | Kamoda et al. | 400/613 |
| 7,563,045 | B2 | 7/2009 | Nagata | |
| 2002/0096075 | A1 * | 7/2002 | Kaya | 101/475 |
| 2007/0009305 | A1 * | 1/2007 | Sakaino et al. | 400/613 |
| 2009/0193836 | A1 * | 8/2009 | Ertz et al. | 62/449 |
| 2011/0097131 | A1 * | 4/2011 | Ishida | 400/611 |

FOREIGN PATENT DOCUMENTS

| | | | |
|---|---|---|---|
| CN | 1269311 | A | 10/2000 |
| CN | 1736838 | A | 2/2006 |
| CN | 1935524 | A | 3/2007 |
| CN | 100519213 | C | 7/2009 |
| EP | 2 329 953 | A1 | 6/2011 |
| JP | 4298356 | | 10/1992 |
| JP | 10181964 | | 7/1998 |
| JP | 2011088372 | | 5/2011 |
| JP | 2011168029 | A | 9/2011 |

* cited by examiner

*Primary Examiner* — Sang Kim
*Assistant Examiner* — Nathaniel Adams
(74) *Attorney, Agent, or Firm* — Winston Hsu; Scott Margo

(57) ABSTRACT

A supporting mechanism applied to a printer is disclosed in the present invention. The supporting mechanism includes a base, a holder slidably disposed on the base for holding a web, a door pivotably disposed on the casing, and a linkage set for moving the holder relative to the base. The linkage set includes a first rod connected between the holder and the door for moving the holder relative to the base when the door rotates, an arm rod pivoted to the casing, and a second rod pivoted to the door and the arm rod for driving the arm rod to press the holder, so as to move the holder relative to the base when the door rotates.

16 Claims, 8 Drawing Sheets

SUPPORTING MECHANISM AND PRINTING DEVICE THEREOF

BACKGROUND OF THE INVENTION

1. Field of the Invention

The present invention relates to a supporting mechanism for webs, and more particularly, to a supporting mechanism with greater webs route and a printer thereof.

2. Description of the Prior Art

Generally, a web exchange mechanism of a conventional printer is disposed inside the casing and located at a position close to an opening of the casing. A door for covering the opening can be unfolded for manually taking the web disposed inside the casing away when the conventional printer is a front-door printer. A lateral wall for covering the opening can be unfolded for taking out the web from the casing when the conventional printer is an edge-door printer. After the web is disposed inside the casing, the lateral wall is folded to close the opening and to finish exchange procedure of the edge-door printer. As mentioned above, the web is disposed on a position adjacent to the opening of the casing in the conventional printer. A user opens the door (or the lateral wall) to take the web away immediately. However, if the printer has huge volume, the web disposed inside the casing can not be taken away via the opening easily after the door (or the lateral wall) is open. Therefore, an exchange mechanism capable of moving the web from inner of the casing to the position close to the opening is an important issue in the mechanical industry.

SUMMARY OF THE INVENTION

The present invention provides a supporting mechanism with greater webs route and a printer thereof for solving above drawbacks.

According to the claimed invention, a supporting mechanism is applied to a printer. The supporting mechanism includes a base, a holder slidably disposed on the base for holding a web, a door pivotably disposed on a bottom of a casing, and a linkage set for moving the holder relative to the base. The linkage set includes a first rod, an arm rod and a second rod. Two ends of the first rod are respectively connected to the holder and the door, the first rod moves the holder relative to the base along a second direction when the door pivots relative to the base along a first direction. An end of the arm rod pivots to the casing. Two ends of the second rod respectively pivot to the door and the arm rod. The second rod drives the arm rod to press the holder when the door pivots relative to the base along a direction opposite to the first direction, so as to move the holder relative to the base along a direction opposite to the second direction.

According to the claimed invention, a contacting portion is disposed on a lateral side of the holder adjacent to the arm rod, and the arm rod presses the contacting portion to move the holder relative to the base.

According to the claimed invention, the supporting mechanism further includes a slide set disposed on the casing. The slide set includes a sliding rail disposed on a wall of the casing, and a sliding component movably disposed inside the sliding rail for moving the holder. The end of the first rod pivots to the sliding component.

According to the claimed invention, the linkage set further includes a constraining component pivoting to the base, and a hook of the constraining component is for hooking a pin of the holder. The linkage set further includes an actuating component pivoting to a wall of the casing, and a third rod. Two ends of the third rod respectively pivot to the door and the actuating component. The third rod rotates the actuating component relative to the base when the door pivots relative to the base along the first direction, so as to separate the hook of the constraining component from the pin.

According to the claimed invention, the linkage set further includes a resilient component disposed between the base and the constraining component for locking the hook of the constraining component on the pin.

According to the claimed invention, the third rod includes a first part and a second part, and two ends of the first part are respectively connected to the door and the second part. The second part is bent relative to the first part and connected to the actuating component.

According to the claimed invention, a slot is formed on a surface of the constraining component, and a protrusion of the base is disposed inside the slot.

According to the claimed invention, a direction of the slot is substantially equal to a pivoting direction of the constraining component relative to the base.

According to the claimed invention, the constraining component and the actuating component are L-shaped structures.

According to the claimed invention, a printer includes a casing, and a supporting mechanism disposed inside the casing. The casing includes a bottom and a plurality of walls, and an opening is formed between the bottom and the walls. The supporting mechanism includes a base, a holder slidably disposed on the base for holding a web, a door pivotably disposed on a bottom of a casing, and a linkage set for moving the holder relative to the base. The linkage set includes a first rod, an arm rod and a second rod. Two ends of the first rod are respectively connected to the holder and the door, the first rod moves the holder relative to the base along a second direction when the door pivots relative to the base along a first direction. An end of the arm rod pivots to the casing. Two ends of the second rod respectively pivot to the door and the arm rod. The second rod drives the arm rod to press the holder when the door pivots relative to the base along a direction opposite to the first direction, so as to move the holder relative to the base along a direction opposite to the second direction.

The supporting mechanism of the present invention can utilize the linkage set and the slide set to move the holder relative to the base when the door opens, so as to pull out the holder from the inner casing to the position close to the opening of the casing, and then the user can exchange the web on the holder easily. Therefore, the supporting mechanism of the present invention can be applied to a specific printer with huge volume, the holder can be pushed in and pulled out by the linkage set and the slide set when folding and unfolding the door, so as to effectively simplify the procedures of webs exchange for increasing operating convenience.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
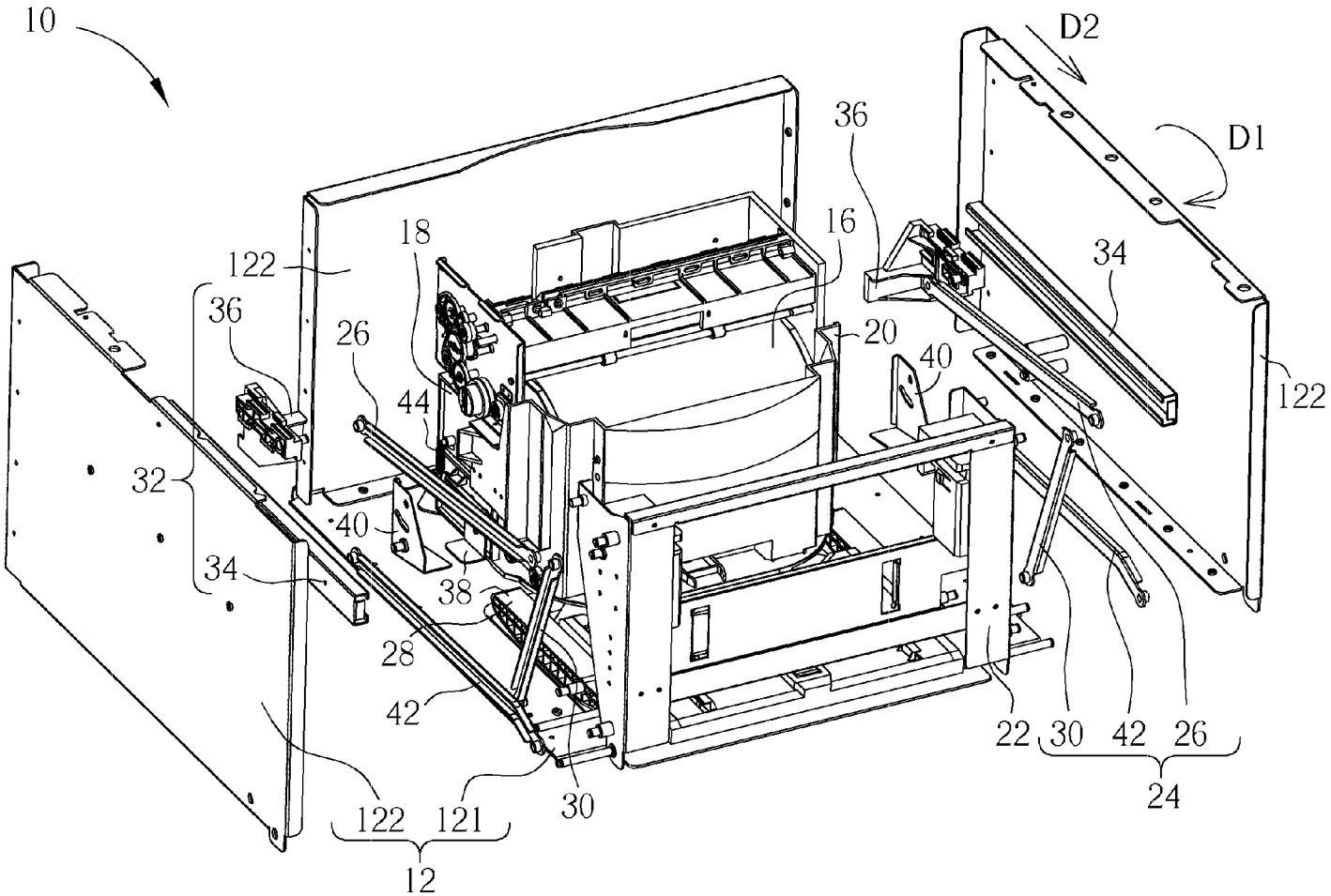
FIG. 1 is an exploded diagram of a printer according to an embodiment of the present invention.
Figure 2:
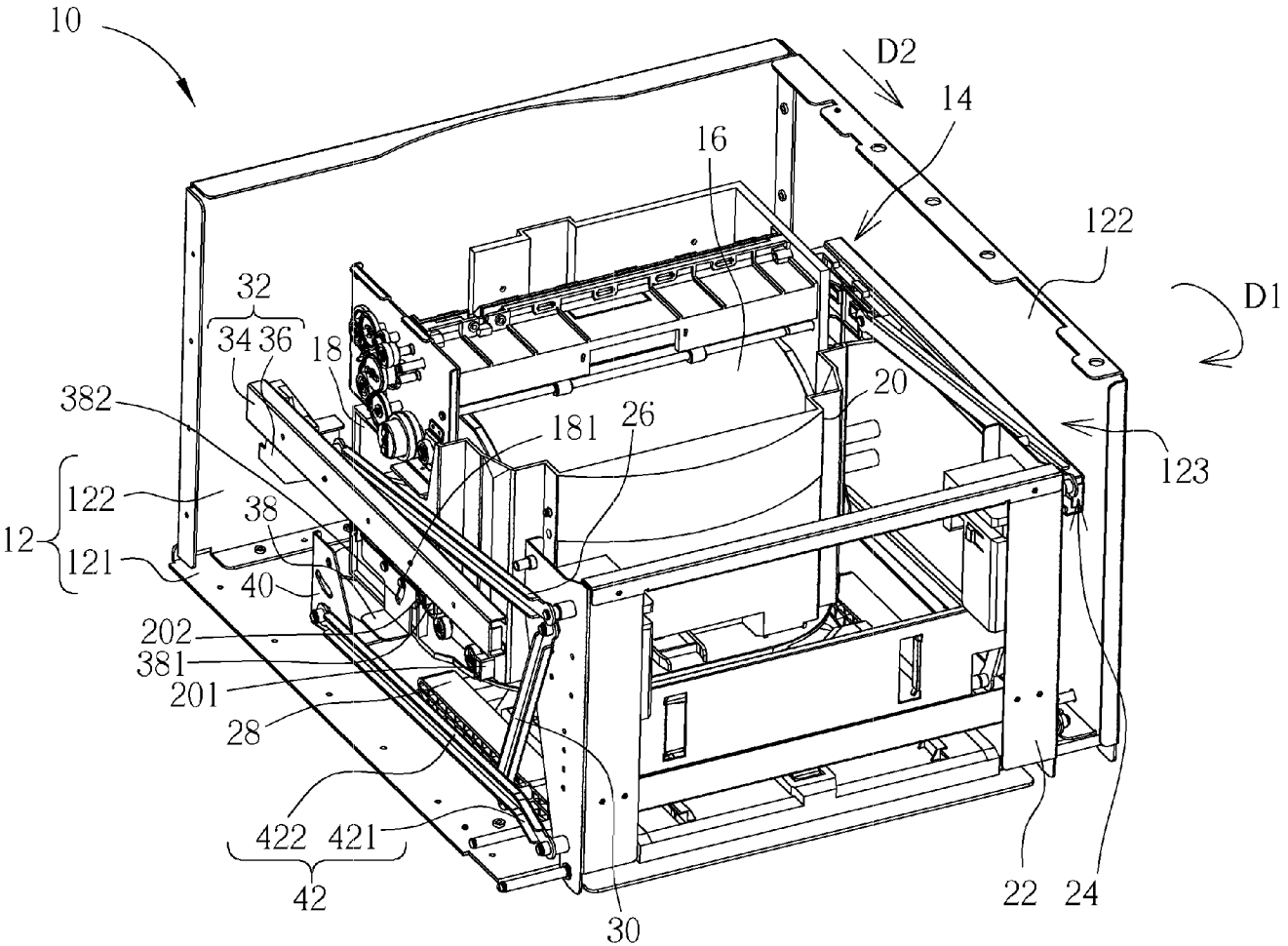
FIG. 2 is an assembly diagram of the printer according to the embodiment of the present invention.

Please refer to FIG. 1 and FIG. 2. FIG. 1 is an exploded diagram of a printer 10 according to an embodiment of the present invention. FIG. 2 is an assembly diagram of the printer 10 according to the embodiment of the present invention. The printer 10 can be a printing device which includes a casing 12 and a supporting mechanism 14. The supporting mechanism 14 can be disposed inside the casing 12 for supporting a web 16, which is composed of paper (printing medium). The casing 12 includes a bottom 121 and a plurality of walls 122, and the walls 122 are respectively disposed around the bottom 121. An opening 123 is formed on the casing 12 and can be located on an edge of the bottom 121 whereon the wall 122 is not disposed. The web 16 can be put into or taken out from the casing 12 via the opening 123.

The supporting mechanism 14 includes a base 18 disposed on the bottom 121, a holder 20 slidably disposed on the base 18 for holding the web 16, a door 22 pivotably disposed on a shaft of the bottom 121 for covering the opening 123 of the casing 12, and two linkage sets 24 for moving the holder 20 relative to the base 18. The shaft can be disposed on the edge of the bottom 121 whereon the wall 122 is not disposed. Two ends of the shaft can be respectively fixed on the opposite lateral walls 122, so that a rotary center of the door 22 is positioned on the walls 122. The linkage sets 24 can be respectively disposed on two opposite sides of the holder 20, such as the left side and the right side. The base 18 can includes several mechanical elements, such as rolls, motors, gear wheels and so on. When the web 16 moves into the casing 12 at a predetermined position with a movement of the holder 20, the base 18 can be utilized to execute paper pick-up procedures and feed-delivery procedures. The bottom 121 and the base 18 can be regarded as the same structural element.

The linkage set 24 includes a first rod 26, an arm rod 28 and a second rod 30. Two ends of the first rod 26 are respectively connected to the holder 20 and the door 22. When the door 22 pivots relative to the base 18 (or the bottom 121 of the casing 12) along a first direction D1 (as a clockwise direction shown in FIG. 2), the first rod 26 can move the holder 20 relative to the base 18 along a second direction D2, so the web 16 can be taken out from the casing 12 easily. An end of the arm rod 28 pivots to the shaft of the wall 122, and the other end of the arm rod 28 is a free end. Two ends of the second rod 30 respectively pivot to the door 22 and the arm rod 28. When the door 22 rotates relative to the base 18 along a direction opposite to the first direction D1, the second rod 30 can drive the arm rod 28 to press the holder 20, so as to move the holder 20 relative to the base 18 along a direction opposite to the second direction D2. Therefore, the web 16 can move into the casing 12 with the holder 20 for setting at the predetermined position. Contacting portions 201 can be disposed on two lateral sides of the holder 20 adjacent to the arm rods 28, respectively. The arm rod 28 can press the contacting portion 201 to slide the holder 20 relative to the base 18.

As shown in FIG. 1 and FIG. 2, the supporting mechanism 14 can further include two slide sets 32. Each slide set 32 can include a sliding rail 34 disposed on the corresponding wall 122 of the casing 12, and a sliding component 36 disposed inside the sliding rail 34 for moving the holder 20. The sliding component 36 is constrained to slide along the sliding rail 34 in parallel. The sliding component 36 can be actuated to move the holder 20 relative to the base 18 when pivoting the door 22. The end of the first rod 26 can pivot to the sliding component 36 for driving the holder 20. When the door 22 is pulled, the first rod 26 can slide the sliding component 36 inside the sliding rail 34 by the door 22, so as to move the holder 20 to a position close to the opening 123 of the casing 12. In addition, the linkage set 24 can further include a constraining component 38 pivoting to the base 18, an actuating component 40 pivoting to the wall 122, a third rod 42 wherein two ends of the third rod 42 respectively pivot to the door 22 and the actuating component 40, and a resilient component 44 disposed between the base 18 and the constraining component 38. The resilient component 44 can be utilized to lock a hook 381 of the constraining component 38 on a pin 202 of the holder 20, so as to constrain the movement of the holder 20 relative to the base 18.

Furthermore, the third rod 42 can pivot the actuating component 40 relative to the base 18 in a counterclockwise direction (the direction opposite to the first direction D1) when the door 22 rotates relative to the base 18 along the first direction D1, so as to separate the hook 381 of the constraining component 38 from the pin 202. Meanwhile, the holder 20 can be pulled to the position close to the opening 123 of the casing 12 by the door 22 via the first rod 26. It is to say, the constraining component 38 and the actuating component 40 can respectively be L-shaped structures, and low edges of the L-shaped structures overlap for synchronal rotation.

It should be mentioned that the third rod 42 can includes a first part 421 and a second part 422. Two ends of the first part 421 are respectively connected to the door 22 and the second part 422. The second part 422 is bent relative to the first part 421 and connected to the actuating component 40 for forming a curved structure. The actuating component 40 can pivot relative to the base 18 by the curved structure of the third rod 42 smoothly. For example, the first part 421 can provide an upward force to the second part 422 when the door 22 moves the first part 421, so that the second part 422 can rotate the actuating component 40 relative to the base 18 upwardly (or pivoting the actuating component 40 relative to the base 18 in the counterclockwise direction). The third rod 42 can be designed as a boomerang-type structure. The boomerang-type structure can prevent the door 22 and an axle center of the arm rod 28 from interference when the door 22 opens to a maximum angle, such as the door 22 is in a position parallel to the bottom 121. A slot 382 can be formed on a surface of the constraining component 38, and a protrusion 181 of the base 18 can be disposed inside the slot 382. A direction of the slot 382 can be substantially equal to a pivoting direction of the constraining component 38 relative to the base 18, so that the constraining component 38 can pivot relative to the base 18 stably by an assembly of the slot 382 and the protrusion 181.

Figure 3:
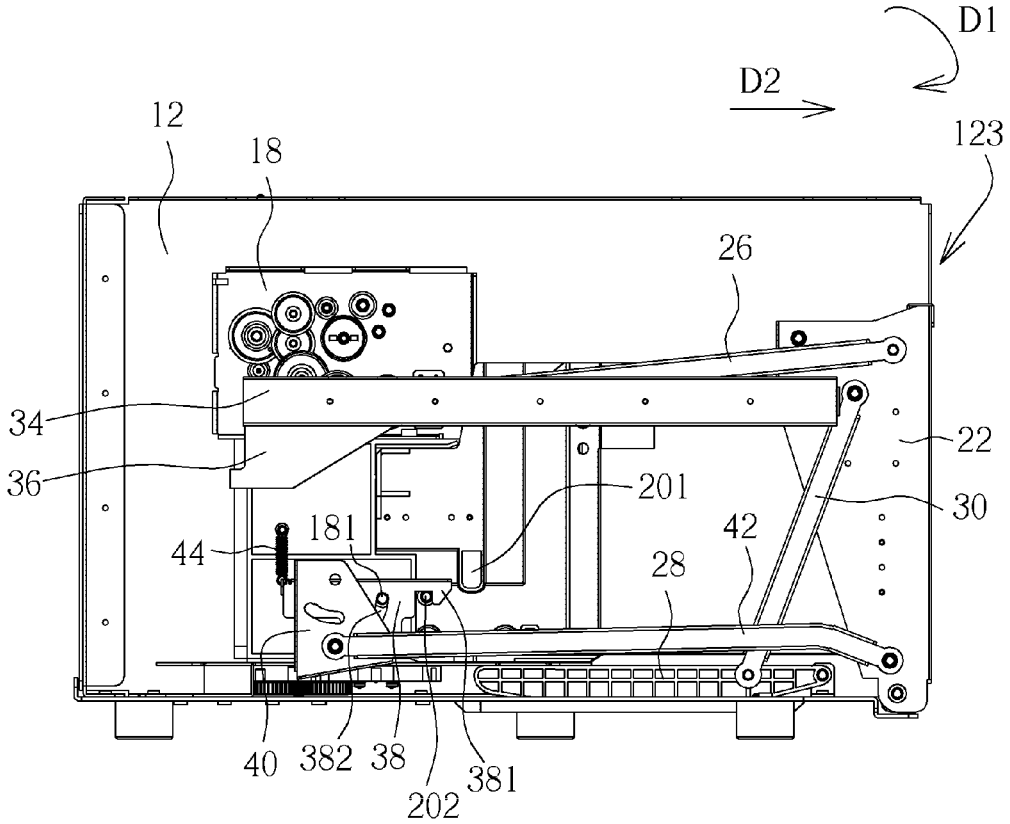
FIG. 3 to FIG. 8 respectively are sectional views of the printer in different operating modes according to the embodiment of the present invention.
Figure 4:
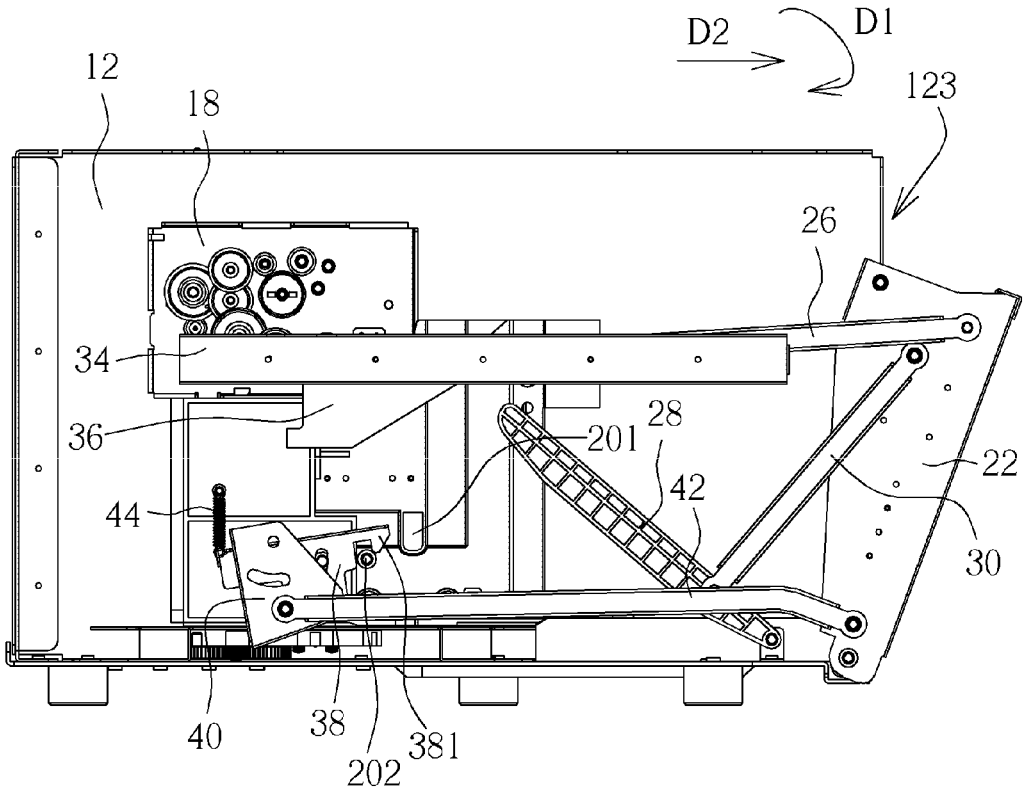
Figure 5:
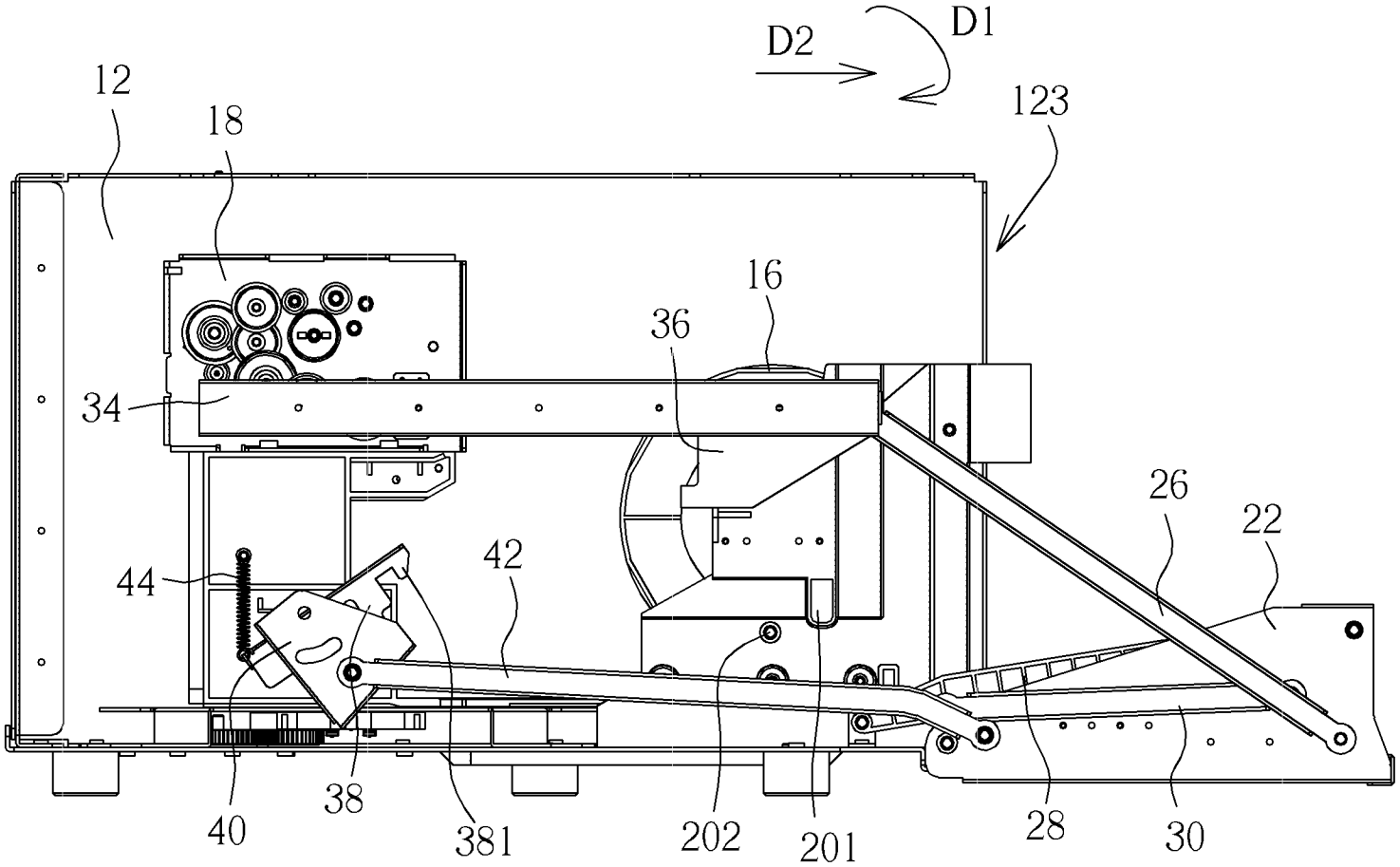
Figure 6:
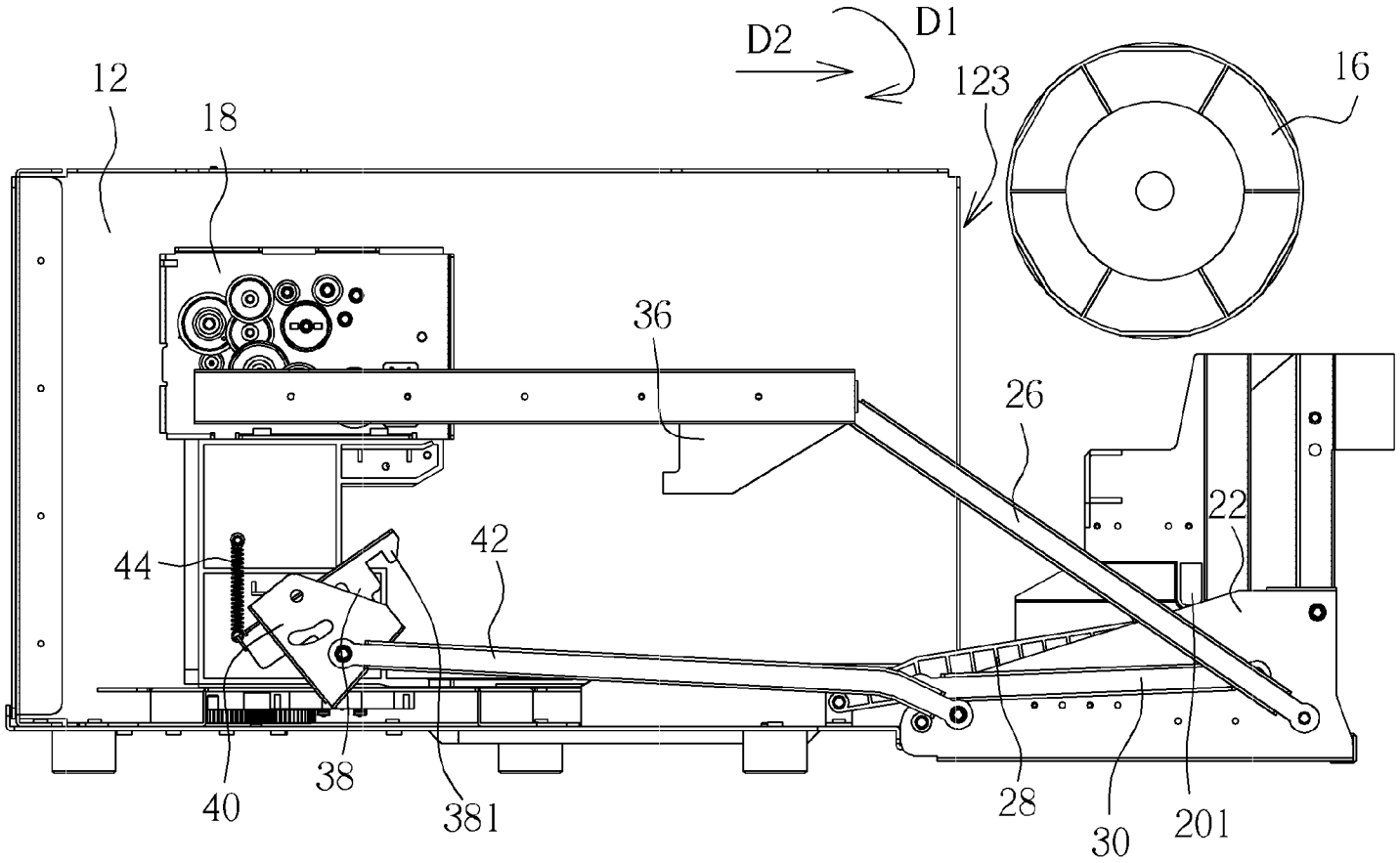

Please refer to FIG. 3 to FIG. 8. FIG. 3 to FIG. 8 respectively are sectional views of the printer 10 in different operating modes according to the embodiment of the present invention. First, the door 22 can be pulled to pivot along the first direction D1 (the clockwise direction) for exposing the opening 123, and then the web 16 can be taken out from the casing 12 easily. As shown in FIG. 3 and FIG. 4, the third rod 42 can pivot the actuating component 40 and the constraining component 38 in the counterclockwise direction, so as to separate the hook 42 from the pin 202 for releasing the constraint. At this time, the resilient component 44 is stretched to store a resilient recovering force, and the first rod 26 can drive the sliding component 36 to slide the holder 20 relative to the sliding rail 34 along the second direction D2. The holder 20 can move relative to the base 18 at the position close to the opening 123 of the casing 12, as shown in FIG. 5 and FIG. 6, so the holder 20 can be taken out from the casing 12 manually for exchanging the web 16. When the door 22 opens, the second rod 30 can rotate the arm rod 28 along the first direction D1. The arm rod 28 can contact against an inner surface of the door 22 as the door 22 opens at the maximum angle.

Figure 7:
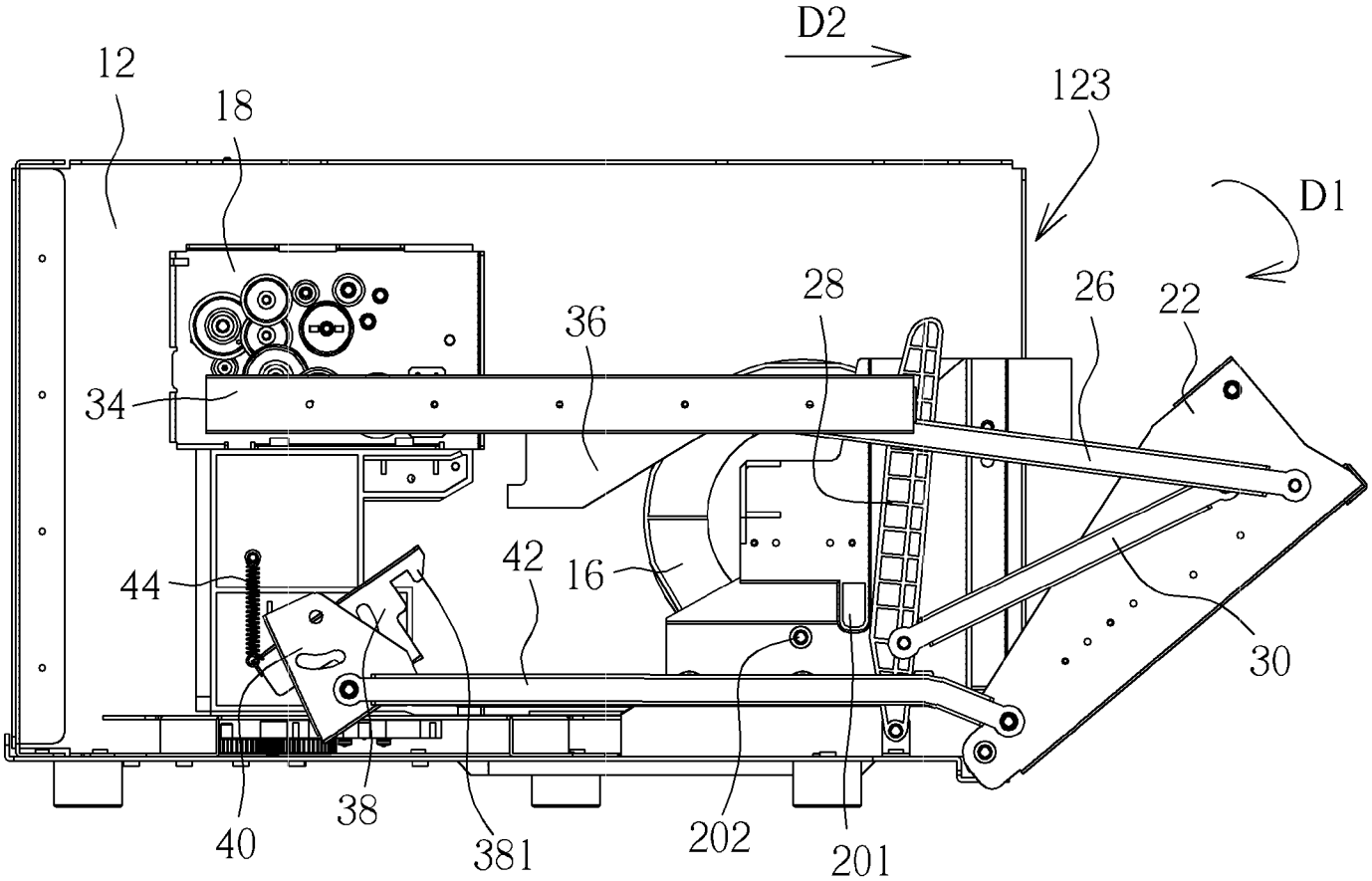
Figure 8:
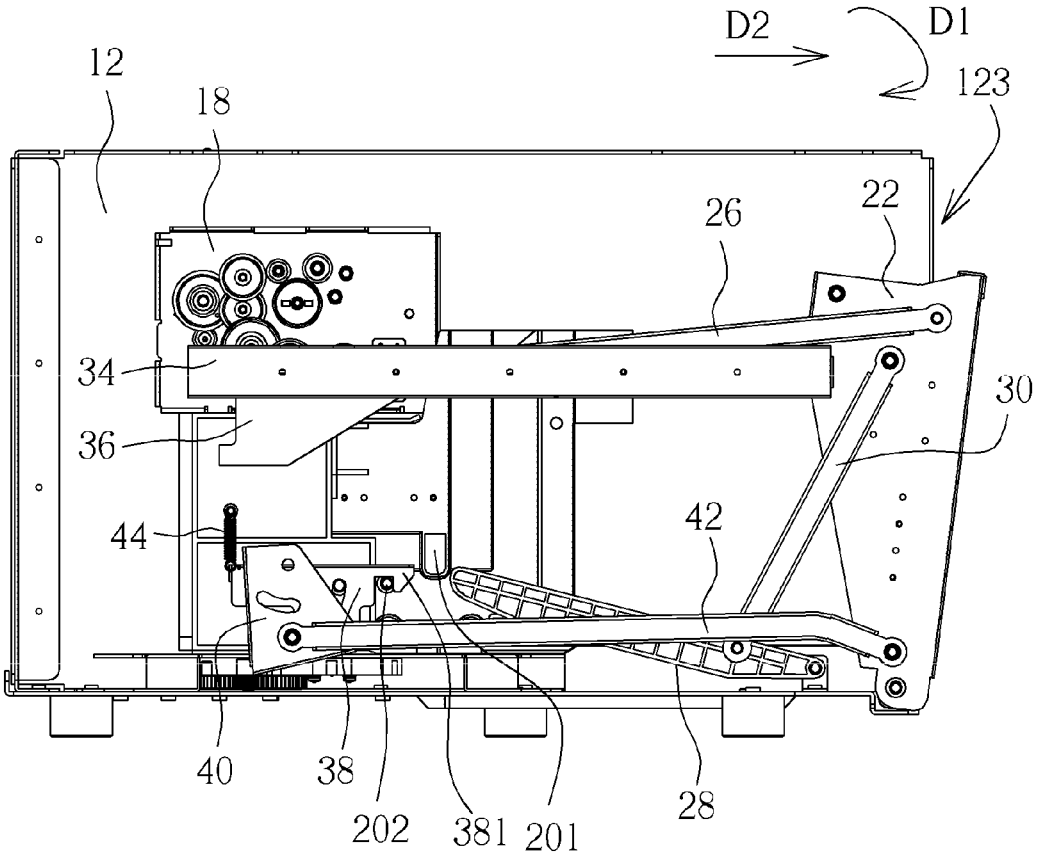

Besides, the holder 20 can be put at the position close to the opening 123 from outside of the casing 12 after the web 16 is installed, as shown in FIG. 6 and FIG. 7. The door 22 can be folded along the direction opposite to the first direction D1 for covering the opening 123. Then, the door 22 and the second rod 30 can drive the arm rod 28 of the linkage set 24 to press the contacting portion 201 of the holder 20, so as to slide the holder 20 into the casing 12 along the direction opposite to the second direction D2. When the door 22 rotates, the third rod 42 can pivot the actuating component 40 along the clockwise direction to space from the constraining component 38. The constraining component 38 is not pressed and can be free to rotate by the resilient recovering force of the resilient component 22, so the hook 381 can lock on the pin 202 of the holder 20 for preventing the holder 20 from moving relative to the base 18.

Comparing to the prior art, the supporting mechanism of the present invention can utilize the linkage set and the slide set to move the holder relative to the base when the door opens, so as to pull out the holder from the inner casing to the position close to the opening of the casing, and then the user can exchange the web on the holder easily. Therefore, the supporting mechanism of the present invention can be applied to a specific printer with huge volume, the holder can be pushed in and pulled out by the linkage set and the slide set when folding and unfolding the door, so as to effectively simplify the procedures of webs exchange for increasing operating convenience.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A supporting mechanism applied to a printing device, the supporting mechanism comprising:
- a base;
- a holder slidably disposed on the base for holding a web, and an image being formed on the web by a printing unit of the printing device;
- a door pivotably disposed on a bottom of a casing, the base being immovably disposed on the bottom of the casing; and
- a linkage set for moving the holder relative to the base, the linkage set comprising:
  - a first rod, two ends of the first rod being respectively connected to the holder and the door, the first rod pulling the holder to linearly slide relative to the base along a second direction when the door pivots relative to the base along a first direction;
  - an arm rod, an end of the arm rod pivoting to the casing; and
  - a second rod, two ends of the second rod being rotatably disposed on the door and the arm rod in a non-slidable manner respectively, a pivot of the arm rod whereon the second rod is rotatably disposed being distant from the foresaid end of the arm rod, the second rod pushing the arm rod to rotate relative to the bottom and to press the holder when the door pivots relative to the base along a direction opposite to the first direction, so as to move the holder relative to the base along a direction opposite to the second direction.

2. The supporting mechanism of claim 1, wherein a contacting portion is disposed on a lateral side of the holder adjacent to the arm rod, the arm rod presses the contacting portion to move the holder relative to the base.

3. The supporting mechanism of claim 1, further comprising:
- a slide set disposed on the casing, the slide set comprising:
  - a sliding rail disposed on a wall of the casing; and
  - a sliding component movably disposed inside the sliding rail for moving the holder, the end of the first rod pivoting to the sliding component.

4. The supporting mechanism of claim 1, wherein the linkage set further comprises:
- a constraining component pivoting to the base, a hook of the constraining component being adapted to hook a pin of the holder;
- an actuating component pivoting to a wall of the casing; and
- a third rod, two ends of the third rod respectively pivoting to the door and the actuating component, the third rod rotating the actuating component relative to the base when the door pivots relative to the base along the first direction, so as to separate the hook of the constraining component from the pin.

5. The supporting mechanism of claim 4, wherein the linkage set further comprises:
- a resilient component disposed between the base and the constraining component for locking the hook of the constraining component on the pin.

6. The supporting mechanism of claim 4, wherein the third rod comprises a first part and a second part, two ends of the first part are respectively connected to the door and the second part, the second part is bent relative to the first part and connected to the actuating component.

7. The supporting mechanism of claim 4, wherein a slot is formed on a surface of the constraining component, and a protrusion of the base is disposed inside the slot.

8. The supporting mechanism of claim 7, wherein a direction of the slot is substantially parallel to a pivoting direction of the constraining component relative to the base.

9. A printing device comprising:
- a casing, the casing comprising a bottom and a plurality of walls, an opening being formed between the bottom and the walls, a printing unit being disposed inside the casing; and
- a supporting mechanism disposed inside the casing, the supporting mechanism comprising:
  - a base immovably disposed on the bottom of the casing;
  - a holder slidably disposed on the base for holding a web, and an image being formed on the web by the printing unit;
  - a door pivotably disposed on the bottom for covering the opening of the casing; and
  - a linkage set for moving the holder relative to the base, the linkage set comprising:
    - a first rod, two ends of the first rod being respectively connected to the holder and the door, the first rod pulling the holder to linearly slide relative to the base along a second direction when the door pivots relative to the base along a first direction;
    - an arm rod, an end of the arm rod pivoting to the bottom; and
    - a second rod, two ends of the second rod being rotatably disposed on the door and the arm rod in a non-slidable manner respectively, a pivot of the arm rod whereon the second rod is rotatably disposed being distant from the foresaid end of the arm rod, the second rod pushing the arm rod to rotate relative to the bottom and to press the holder when the door pivots relative to the base along a direction opposite to the first direction, so as to move the holder relative to the base along a direction opposite to the second direction.

10. The printing device of claim 9, wherein a contacting portion is disposed on a lateral side of the holder adjacent to the arm rod, the arm rod presses the contacting portion to move the holder relative to the base.

11. The printing device of claim 9, wherein the supporting mechanism further comprises a slide set disposed on the casing, the slide set comprises:

a sliding rail disposed on the wall of the casing; and a sliding component movably disposed inside the sliding rail for moving the holder, the end of the first rod pivoting to the sliding component.

12. The printing device of claim 9, wherein the linkage set further comprises:

a constraining component pivoting to the base, a hook of the constraining component being adapted to hook a pin of the holder;

an actuating component pivoting to the wall; and a third rod, two ends of the third rod respectively pivoting to the door and the actuating component, the third rod rotating the actuating component relative to the base when the door pivots relative to the base along the first direction, so as to separate the hook of the constraining component from the pin.

13. The printing device of claim 12, wherein the linkage set further comprises:

a resilient component disposed between the base and the constraining component for locking the hook of the constraining component on the pin.

14. The printing device of claim 12, wherein the third rod comprises a first part and a second part, two ends of the first part are respectively connected to the door and the second part, the second part is bent relative to the first part and connected to the actuating component.

15. The printing device of claim 12, wherein a slot is formed on a surface of the constraining component, and a protrusion of the base is disposed inside the slot.

16. The printing device of claim 15, wherein a direction of the slot is substantially parallel to a pivoting direction of the constraining component relative to the base.

* * * * *